US005631563A

United States Patent [19]

Moriarty

[11] Patent Number: 5,631,563

[45] Date of Patent: May 20, 1997

[54] RESISTIVITY ANTENNA SHIELD, WEAR BAND AND STABILIZER ASSEMBLY FOR MEASURING-WHILE-DRILLING TOOL

[75] Inventor: Keith A. Moriarty, Houston, Tex.

[73] Assignee: Schlumbreger Technology Corporation, Sugar Land, Tex.

[21] Appl. No.: 360,099

[22] Filed: Dec. 20, 1994

[51] Int. Cl.[6] ..... G01V 3/18; F16L 25/00

[52] U.S. Cl. ..... 324/338; 324/339; 285/333; 285/45; 285/328; 285/391; 175/325.5

[58] Field of Search ..... 175/40, 320, 325.2, 175/325.5, 325.6; 285/81, 328, 333, 391, 45, 331; 343/719, 720; 324/338, 332, 339, 344, 333, 334

[56] References Cited

U.S. PATENT DOCUMENTS

| | | | |
|---|---|---|---|
| 1,446,789 | 2/1923 | Dodd | 166/75.11 |
| 2,455,180 | 11/1948 | Kennedy | 285/404 |
| 2,708,132 | 5/1955 | O'Neill | 285/81 X |
| 2,758,891 | 8/1956 | Kammerer | 175/325.3 |
| 2,813,697 | 11/1957 | Swart | 175/325.4 |
| 3,015,500 | 1/1962 | Barnett | 285/81 X |
| 3,164,216 | 1/1965 | Hall, Sr. et al. | 175/323 |
| 3,285,678 | 11/1966 | Garrett et al. | 175/325.2 |
| 3,292,708 | 12/1966 | Mundt | 166/241.6 |
| 3,329,212 | 7/1967 | Pourchot | 166/176 |
| 3,345,084 | 10/1967 | Hanes et al. | 285/391 X |
| 3,370,894 | 2/1968 | Pourchot | 166/241.4 |
| 3,397,017 | 8/1968 | Grant et al. | 175/325.7 |
| 3,410,613 | 11/1968 | Kuus | 175/325.7 |
| 3,420,323 | 1/1969 | Owens | 175/323 |
| 3,482,889 | 12/1969 | Cochran | 175/325.7 |
| 3,528,499 | 9/1970 | Collett | 166/175 |
| 3,560,060 | 2/1971 | Morris | 166/241.4 |
| 3,709,569 | 1/1973 | Napper | 175/325.7 |
| 3,894,779 | 7/1975 | Hoon et al. | 175/325.6 |
| 3,894,780 | 7/1975 | Broussard | 175/325.6 |
| 3,916,998 | 11/1975 | Bass, Jr. et al. | 166/301 |
| 3,933,203 | 1/1976 | Evans | 166/241.6 |
| 3,938,853 | 2/1976 | Jurgens et al. | 175/325.2 |
| 3,942,824 | 3/1976 | Sable | 285/333 X |
| 3,945,446 | 3/1976 | Ostertag et al. | 175/323 |
| 4,002,359 | 1/1977 | Lari | 285/333 X |
| 4,011,918 | 3/1977 | Jurgens | 175/325.2 |
| 4,036,539 | 7/1977 | Saunders et al. | 175/325.2 |
| 4,042,023 | 8/1977 | Fox | 166/241.7 |
| 4,124,231 | 11/1978 | Ahlstone | 285/18 |
| 4,266,578 | 5/1981 | Swain et al. | 138/110 |
| 4,275,935 | 6/1981 | Thompson et al. | 175/325.7 |
| 4,345,785 | 8/1982 | Bradford | 285/50 |
| 4,514,693 | 4/1985 | Meador | 324/338 |
| 4,536,714 | 8/1985 | Clark | 324/338 |
| 4,819,974 | 4/1989 | Zeidler | 285/373 |
| 4,911,479 | 3/1990 | Claycomb | 285/328 X |
| 4,949,045 | 8/1990 | Clark et al. | 324/338 |
| 4,984,633 | 1/1991 | Langer et al. | 166/241.1 |
| 5,090,500 | 2/1992 | Yousef et al. | 175/320 |
| 5,396,232 | 3/1995 | Mathieu et al. | 175/40 |

FOREIGN PATENT DOCUMENTS

| | | | |
|---|---|---|---|
| 609086 | 8/1926 | France | 285/391 |
| 0840317 | 7/1981 | U.S.S.R. | 324/338 |
| 242501 | 11/1925 | United Kingdom | 285/391 |
| 1372181 | 10/1974 | United Kingdom . | |
| 2171436 | 8/1986 | United Kingdom . | |

*Primary Examiner*—Sandra L. O'Shea
*Assistant Examiner*—Jay M. Patidar
*Attorney, Agent, or Firm*—David L. Moseley; Wayne I. Kanak

[57] ABSTRACT

A sensor protection system for use with an MWD tool includes a tubular body having lesser and greater diameter portions, antennas mounted in grooves in the lesser diameter portion, shield sleeves covering the antennas and being locked in place against longitudinal and rotational movement, and a wear band on the greater diameter portion to provide a standoff for the shield sleeve, the wear band also being locked against movement in the longitudinal and rotational directions. The locking mechanism also can be used to fix a sleeve-type stabilizer on the tubular body.

15 Claims, 2 Drawing Sheets

RESISTIVITY ANTENNA SHIELD, WEAR BAND AND STABILIZER ASSEMBLY FOR MEASURING-WHILE-DRILLING TOOL

BACKGROUND OF THE INVENTION

1. Field of the Invention

This invention relates generally to the protection of sensors used on a measuring-while-drilling (MWD) tool, and particularly to a new and improved resistivity antenna shield and wear band assembly that isolates a measuring coil or the like from environmental forces experienced in hostile drilling conditions. The invention also is applicable to a replaceable stabilizer means that substantially centers the tool in a borehole.

2. Description of the Related Art

An MWD measuring tool generally includes a specially made housing or collar having sensors and which is connected in the drill string above the bit. One type of sensor that typically is used is one that enables the electrical resistivity of the rock formations surrounding the borehole to be measured as the hole is deepened by the bit. Mud pulse signals that are representative of such measurements are telemetered uphole where they are detected, processed and displayed and/or recorded as a log of resistivity values versus depth. A resistivity measuring system typically includes one or more transmitting antennas that direct electric current into the formation and two spaced antenna coils that detect returning currents. A comparison of the amplitude or phase shift of the returning current at the receiving coils enables the electrical resistivity of the rock to be determined. Resistivity is a key characteristic in determining whether the rock might contain hydrocarbons.

Directional wells can be drilled with a short radius curved section to establish a new inclination which may bring the borehole to horizontal. As the inclination is rapidly built up, bending of the tool can cause the sensors to engage the borehole wall. When this occurs, friction loads cause rapid wear and other damage so that the sensors can become inoperative. In prior MWD tools, efforts have been made to provide protection for an antenna coil so that it will be more resistant to hostile environmental forces. For example, shields and wear bands having a variety of mechanical fasteners have been employed, all of which are vulnerable to some degree to failure resulting from loosening of such fasteners. Moreover external fasteners that are exposed to high mechanical impact loads against the side of a borehole have been a longstanding weakness in the design of MWD resistivity tools. Thus there is a need to fasten such shields and wear bands in a manner such that the problem of loosening and failure in the borehole is eliminated.

Another component typically used on an MWD tool is a stabilizer which includes a sleeve having a plurality of outwardly directed, longitudinal ribs whose outer faces engage the borehole wall to maintain the sensor collar substantially centered in the borehole. The diameter of such faces can be full-gauge or under-gauge with respect to the gauge diameter of the drill bit, depending upon requirements. It is desirable to mount such a stabilizer on a "slick" collar, that is, a collar without machined upsets for integrally formed threads. If such upsets are not present, the collar would not be destroyed when washed over during a fishing operation. The present invention thus allows more design freedom in placement of sleeves, wear bands and stabilizers.

An object of the present invention is to provide a new and improved antenna coil protection that eliminates the need for external fasteners and thus is more reliable and maintenance free than prior devices.

Another object of the present invention is to provide a new and improved antenna coil protection that can be easily installed in the field in a simple, reliable and maintenance-free manner.

Still another object of the present invention is to provide a new and improved combination of an antenna coil shield with a wear band that provides standoff for the coil.

Yet another object of the present invention is to provide a replaceable sleeve stabilizer that is mounted on a collar by new and improved coupling means that is more reliable and maintenance-free than prior devices for this purpose.

SUMMARY OF THE INVENTION

These and other objects are attained in accordance with the present invention through the provision of an MWD measuring tool including a body or collar having an external groove in which an antenna coil is mounted. A shield sleeve is positioned over the coil and held in place by a unique lock assembly or coupling having ring segments that engage in arcuate collar grooves and which are threaded to the sleeve. The lock assembly prevents longitudinal and rotational sleeve movement without any projections that can engage the wellbore wall. In combination with such shield sleeve, at least one wear band is mounted on the collar adjacent the shield sleeve and has a greater outer diameter. The wear band is fixed to the collar by the same type locking assembly described above, and provides a stand-off for the shield sleeve should the collar tend to engage the wellbore wall during drilling. One or more stabilizer sleeves can be mounted on the collar in the same manner in order to center the collar in the borehole. The wear band and/or the stabilizer sleeve is readily replaceable during a trip of the drill string to change bits or the like, in case extraordinary wear has taken place. The combination of elements is highly resistant to environmental forces encountered in hostile well drilling conditions.

BRIEF DESCRIPTION OF THE DRAWINGS

The present invention has the above as well as other objects, features, and advantages which will become more clearly apparent in connection with the following detailed description of a preferred embodiment, taken in conjunction with the appended drawings in which.

DESCRIPTION OF A PREFERRED EMBODIMENT

Figure 1:
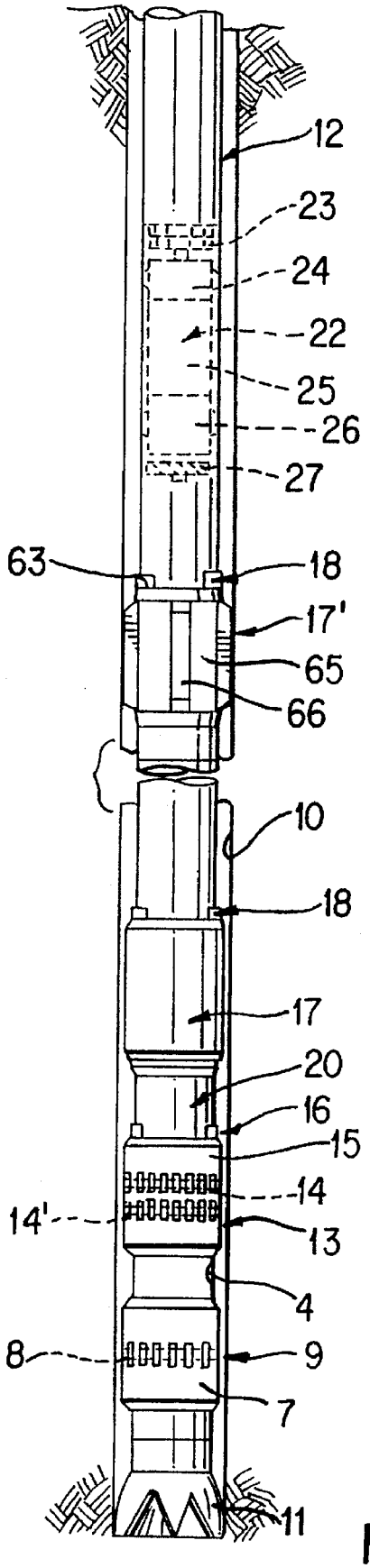
FIG. 1 is a schematic view of a measuring-while-drilling system suspended in a wellbore on a drill string.

Referring initially to FIG. 1, a borehole 10 is shown being drilled through earth formations by a rotary bit 11 on the lower end of a drill string 12. To make measurements of a characteristic property of the earth formations surrounding the borehole as it is deepened, such as their electrical resistivity, a transmitting antenna 9 is used to inject current into the formation and an antenna assembly 13 including vertically spaced receiving antennas 14 and 14' are used to sense returning current. The resistivity of the rock affects the amplitude and phase of the returning current, which enables a log of the measured values to be made as drilling proceeds. The receiving antennas 14, 14' can be protected by a single shield sleeve 15 that is held in place by a lock assembly 16 to be described in greater detail below, or separate shield sleeves can be used. A wear band 17 having a larger diameter than the sleeve 15 is mounted on the collar 20 above the sleeve 15 and also is held in place by a similar lock assembly indicated generally at 18. The wear band 17 prevents the shield sleeve 15 from contacting the walls of the borehole 10 and thus protects it and the receiving antennas 14 and 14' from damage. The transmitting antenna 9 includes a coil 8 that is protected by another shield sleeve 7 which is coupled to the collar 20 in the same way as the upper sleeve 15 and the wear band 17. Another wear band (not shown) can be mounted on the collar 20 below the lower shield sleeve 7 which surrounds the coil 8 if desired. The one-transmitter two-receiver arrangement described above is a desirable measurement method for obtaining resistivity values at two different depths of investigation into the formations.

Signals from the receiving antennas 14 and 14' are processed and then fed up to an MWD telemetry tool 22 which generates pressure pulses in the mud stream which are representative thereof. Such pulses travel up to the surface where they are detected by a pressure transducer and fed to a computer and a recorder for display and analysis. Of course numerous other measurements such as natural gamma radiation, weight and torque on bit, and hole direction parameters also can be made and sent uphole in a series of mud pulse signals. The MWD telemetry tool 22 is a self-contained system and includes a signaling valve or siren 23 that interrupts mud flow, a drive motor and controller 24, a signal processor 25, and an electrical power supply 26 driven by a turbine 27. See U.S. Pat. Nos. 4,100,528, 4,103,281 and 4,167,000, which are incorporated herein by reference, for further details of the MWD tool 22.

Figure 2:
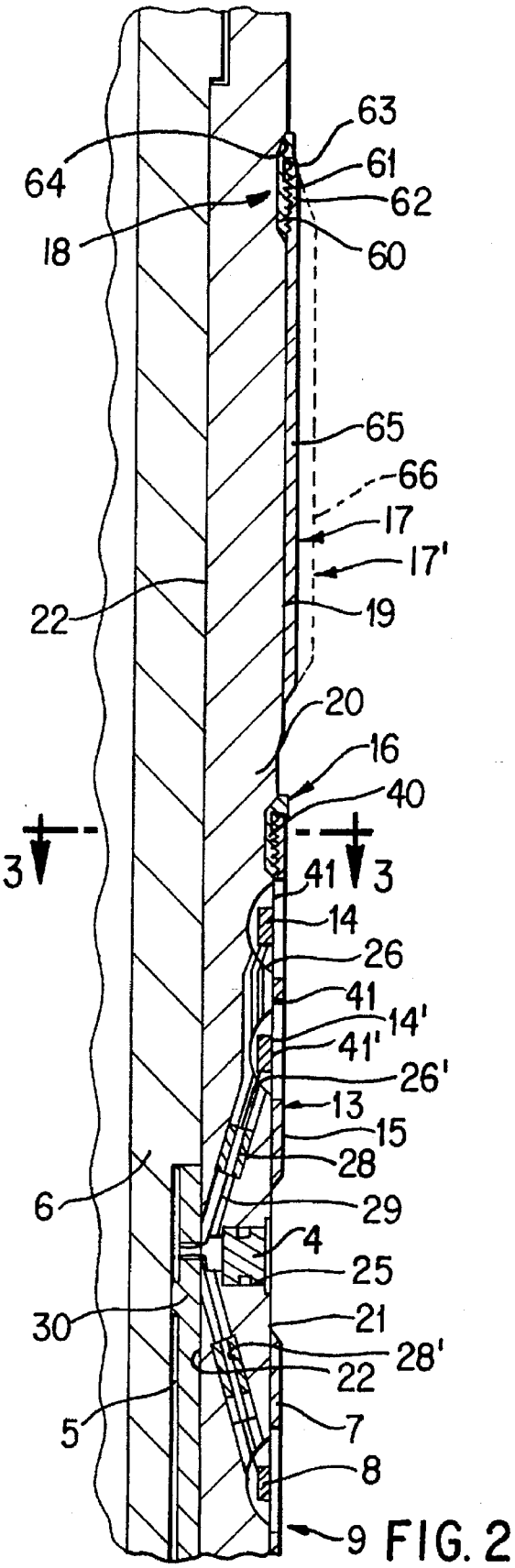
FIG. 2 is an enlarged, fragmentary, longitudinal sectional view showing the combination of transmitting and receiving antenna shield sleeves and a wear band/stabilizer sleeve each being locked in place in accordance with this invention.

Referring now to FIG. 2, the tubular collar 20 has a generally smooth outer surface formed with diameters 19 and 21, the diameter 19 being somewhat greater than the diameter 21. The collar 20 has an inner cylindrical wall 22 that defines a longitudinal bore. A housing 6 mounted inside the collar 20 forms an atmospheric chamber 5 in which various circuit components are located. A connector access plug 4 is fixed in a radial hole 25 in the wall of the collar 20. The receiving antennas 14 and 14' are mounted in annular grooves 26, 26' in the collar 20. The ends of the coil conductors which comprise receiving antennas 14, 14' extend to a high pressure feed-through connector 28 which electrically couples the coil conductors to pairs of wires 29 that extend to an electrical circuit on a signal processor 30. The grooves 26, 26' can have semi-circular inner walls and are filled with an insulated composite material that is molded therein. Then a rectangular groove is machined in the respective composite materials, and the antennas 14, 14' positioned therein. Finally these grooves are filled with an epoxy compound and over-molded with an elastomeric compound which is flush with the collar diameter 21 as shown. The transmitting antenna 9 is made in the same way, with its conductor leads going through a feed-through 28'. The shield sleeve 7 mounts on diameter 21 and is coupled to the collar 20 as described below.

Figure 3:
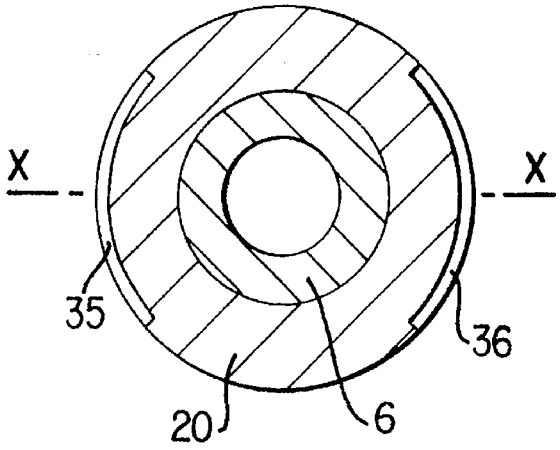
FIG. 3 is a cross-section on line 3—3 of FIG. 2 to show the collar recesses.
Figure 4:
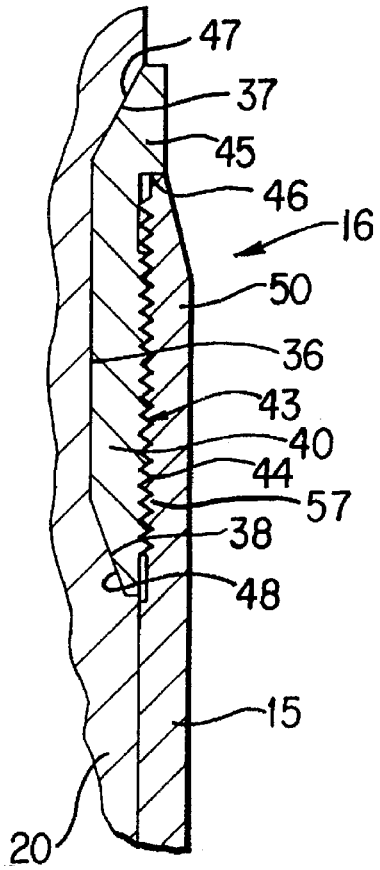
FIG. 4 is a further enlarged, sectional view showing a lock ring segment with sleeve threaded thereto.

The shield sleeve 15 slides onto the collar 20 and then is locked in position by an assembly 16 shown in enlarged detail in FIGS. 3 and 4. Diametrically opposed arcuate grooves 35, 36 (FIG. 3) having oppositely sloped end surfaces 37, 38 are formed in the outer periphery of the collar 20. Ring segments 40 are positioned in the respective grooves 35, 36 with each groove and segment extending through an angle of about 90° and being symmetrically arranged about axis x—x as depicted in FIG. 3. Each segment 40 has a reduced diameter outer surface 43 that is threaded at 44, and an enlarged diameter end portion 45 providing a stop shoulder 46. Each ring segment 40 also has upper and lower inclined surfaces 47, 48 which are companion in shape and spacing to the surfaces 37, 38 of the collar grooves 35, 36. The segments 40 preferably are formed from an initially continuous ring which is threaded and otherwise machined and then cut radially into four individual segments. Two diametrically opposed segments then are positioned in the respective grooves 35, 36 so that the male thread forms 44 match circumferentially and are correctly oriented with respect to the thread lead distance even in view of the 90° gap between adjacent ends of the segments.

The shield sleeve 15 has an upper portion 50 with internal threads 57 that mate with the threads 44 on the ring segments 40. The threads 57, 44 are right-hand so that if the sleeve 15, installed from the bottom, rubs against the borehole wall during drilling, the torque generated is in the same direction as the tightening torque during installation. Alternatively, a sleeve installed from the top of the tool would have left hand threads so that the torque generated with borehole wall contact during drilling would again be in the same direction as the tightening torque. Thus the ring segments 40 prevent longitudinal as well as rotational movement of the shield sleeve 15 relative to the collar 20. A plurality of angularly spaced longitudinal slots or windows 41, 41' can be formed in the sleeve 15 and extend above and below the respective antenna coils 14, 14'.

The wear band 17 also slides over the collar diameter 19 and has its upper end portion locked to the collar 20 above the shield sleeve 15 in the same manner but with ring segment parts that are correspondingly larger. The arcuate grooves 60 also are arranged with surfaces like those shown in FIG. 4, and receive ring segments 61 onto which the upper end portion 62 of the wear band 17 is threaded. Both the grooves 60 and the ring segments 61 have upper and lower inclined surfaces as shown. When tightened up against the shoulder 63 on the upper portions 64, the wear band 17 is securely locked against longitudinal and rotational movement, and provides stand-off for the shield sleeve 15. The wear band 17 can have a wear-resistant outer surface applied thereto such as welded tungsten carbide or braised and filled tungsten carbide tiles.

The sleeve 65 of the wear band 17 can also be a part of a stabilizer 17' as shown in FIG. 1, such stabilizer having a plurality of angularly spaced, longitudinal ribs or blades 66 also shown in phantom lines in FIG. 2. The outer surfaces of the blades 66 typically are arcuate and have an outer diameter that is the same as the gauge diameter of the bit 11 for a full-gauge stabilizer function, or somewhat less for an under-gauge stabilizer function. Such outer faces also are provided with a wear-resistant substance as disclosed above. The coupling of the stabilizer 17' to the collar 20 is the same as for the wear band 17, which is constituted by the ring segments 61, the grooves 60, and the threaded upper end portion 62 as shown in FIG. 2. When mounted as shown, dragging action against the wellbore wall is in the same direction as when tightening on installation. Of course the stabilizer 17' and additional devices like it can be located at various places on the collar 20, for example near the bit 11 and/or the wear band 17.

OPERATION

In operation in use of the present invention, the collar 20 is made with the various diameters and other structural features shown in FIGS. 2 and 3, and with an upper portion having a diameter 19 that is somewhat larger than its lower portion having the diameter 21. Generally speaking, the outside of the collar 20 is relatively smooth in that there are no projections or upset diameters as in prior devices where various mechanical fasteners or external threads were used to secure shield sleeves, wear bands, replaceable sleeve type stabilizers and the like. This affords an advantage during fishing and washover operations in that the collar is not destroyed, and also permits the installation of multiple sleeves of the same diameter and design adjacent one another. As discussed above, the receiving antennas 14, 14' are assembled in the grooves 26, 26' so that the outer surfaces thereof are flush with the outer diameter 21 of the collar 20, as is the transmitting antenna 9. Then the upper ring segments 61 are positioned in the upper grooves 60 and the wear band 17 or stabilizer 17' is slid upward on the collar 20 until its inner threads engage the external threads on the ring segments 61. The wear band 17 or the stabilizer 17' then is turned to the right to cause the upper portion 62 to thread onto the segments 61 until its upper end surface stops against the shoulder 63. Some tightening can be done with a suitable wrench if desired. The flank pressure of the threads forces the segments 61 tightly into the grooves 60.

Then a pair of the lower ring segments 40 are positioned in the lower arcuate grooves 35, 36, and the shield sleeve 15 is slid up over the collar outer diameter 21 and engaged with the threads 44 on these segments. When the upper end portion 50 of the sleeve 15 abuts the shoulder 46, suitable tightening can be done as above. As the collar 20 is rotated in the borehole 10 during drilling, any torsional forces on either the wear band 17/stabilizer 17' or the sleeve 15 due to friction will be in the same direction as when tightening during installation, thus tending to keep the device properly positioned. Neither the sleeve 15 nor the wear band 17 can move longitudinally due to engagement of the respective segments 40, 61 in the grooves 35, 36, 60. Longitudinal movement also is prevented by engagement with the respective shoulders 45, 63 and by the threaded engagement. The engagement of the ends of the ring segments 40, 61 with adjacent ends of the grooves 35, 36, 60 stops relative rotation.

Finally the shield sleeve 7 for the transmitting antenna 9 is slid up onto the collar diameter 21 until its lower end is above the lowermost arcuate recesses (not shown), and with the left-hand threaded segments in such recesses the sleeve 7 is lowered and then rotated to the left to engage the companion threads and lock the sleeve in place. Any drag forces imparted thereto by the wellbore wall will create torque in the same direction as during tightening of such threaded engagement on installation. Of course the sleeve 7 could be oriented the same as sleeve 15 and right-hand threaded components used to lock the same to the collar 20.

The wear band 17 having a larger outer diameter than that of the shield sleeve 15 protects the shield sleeve and the receiving antennas 14, 14' in the borehole 10 by providing a stand-off that prevents engagement of these parts with the wellbore wall. As noted above, another wear band of identical construction can be mounted on the collar 20 below the antennas 14, 14', and additional assemblies of transmitting antennas and wear bands can be used at different distances from the receiving antennas 14, 14' which affects the depth of investigation and provides compensation for borehole effects. Where needed, one or more of the stabilizers 17' can be coupled to the collar 20.

It now will be recognized that new and improved protective shielding and wear bands for measurements antennas used in an MWD tool have been disclosed. The unique coupling mechanism also is applicable to a sleeve-type stabilizer mounted on a slick collar. Since certain changes or modifications may be made in the disclosed embodiments without departing from the inventive concepts involved, it is the aim of the appended claims to cover all such changes and modifications falling within the true spirit and scope of the present invention.

What is claimed is:

1. A locking assembly for mounting a sleeve on a tubular body, comprising: arcuate recess means in said body; ring segment means mounted in said recess means; and co-engaged means on said ring segment means and said sleeve for locking said sleeve against longitudinal and rotational movement on said body.

2. The assembly of claim 1 wherein said recess means include arcuate recesses each extending for less than 180° around said body and wherein said ring segment means includes individual ring segments that are coextensive with the angular extent of a respective recess.

3. The assembly of claim 2 wherein each of said recesses has oppositely inclined upper and lower surfaces, and each of said ring segments has companion inclined surfaces.

4. The assembly of claim 3 wherein said co-engaged means is constituted by right hand threads, each of said ring segments having a reduced diameter portion on which said threads are formed and an outwardly directed shoulder at one end of said portion, an outer end section of said sleeve having internal threads which mate with said threads on said reduced diameter portion and an end face that engages said shoulder.

5. The assembly of claim 1 further including an external annular groove in said tubular body located underneath said sleeve, and antenna means in said groove adapted to enable measurements of a characteristics property an earth formation.

6. The assembly of claim 5 wherein said sleeve has a plurality of angularly spaced longitudinal slots crossing said groove and antenna means.

7. The assembly of claim 1 further including a plurality of angularly spaced longitudinally extending ribs on said sleeve for substantially centering said body in a borehole.

8. A protection assembly for a sensor on a tubular body, comprising: an external annular groove in said body having an antenna mounted therein; a shield sleeve mounted on said body for protecting said antenna; first locking means including first segmented ring members cooperable with said shield sleeve for preventing longitudinal and rotational movement thereof; wear band means mounted on said body adjacent said shield sleeve and adapted to prevent engagement of said shield sleeve with a wellbore wall; and second locking means including second segmented ring members engageable with said wear band means for preventing longitudinal and rotational movement thereof.

9. The assembly of claim 8 wherein said tubular body has a lesser diameter external surface and a greater diameter external surface, said wear band means being mounted on said greater diameter surface and said shield sleeve being mounted on said lesser diameter surface, so that said wear band means prevents engagement of said shield sleeve with a wellbore wall.

10. The assembly of claim 9 wherein each of said locking means includes diametrically opposed arcuate groove means in said body adapted to receive said ring members, a first connection means between said first ring members and said shield sleeve; and second connection means between said second ring members and said wear band means.

11. The assembly of claim 10 wherein each said connection means includes right hand threads and co-engaged shoulders.

12. The assembly of claim 10 wherein at least one of said connector means includes left-hand threads and co-engaged shoulders.

13. The assembly of claim 10 wherein said groove means and said segmented ring members each have upper and lower oppositely inclined surfaces.

14. The assembly of claim 10 wherein said groove means and ring members extend through an angle that is less than 180°.

15. The assembly of claim 14 wherein said angle is 90°.

* * * * *